US005653731A

United States Patent [19]

Röhrig

[11] Patent Number: 5,653,731

[45] Date of Patent: Aug. 5, 1997

[54] PACIFIER HAVING A SHIELD WITH CHEWING BEADS

[75] Inventor: Peter Röhrig, Vienna, Austria

[73] Assignee: Mam Babyartikel Gesellschaft M.B.H., Vienna, Austria

[21] Appl. No.: 532,616

[22] PCT Filed: Apr. 13, 1994

[86] PCT No.: PCT/AT94/00043

§ 371 Date: Oct. 12, 1995

§ 102(e) Date: Oct. 12, 1995

[87] PCT Pub. No.: WO94/23686

PCT Pub. Date: Oct. 27, 1994

[30] Foreign Application Priority Data

Apr. 21, 1993 [AT] Austria ..... 786/93

[51] Int. Cl.[6] ..... A61J 17/00

[52] U.S. Cl. ..... 606/234

[58] Field of Search ..... 606/234–236; D24/194–199

[56] References Cited

U.S. PATENT DOCUMENTS

| | | | |
|---|---|---|---|
| 3,923,067 | 12/1975 | Hurst | 606/236 |
| 4,577,632 | 3/1986 | Grasset | 606/236 |

FOREIGN PATENT DOCUMENTS

| | | |
|---|---|---|
| 0379508 | 1/1986 | Austria . |
| 1287253 | 1/1969 | Germany . |
| 3316824 | 11/1984 | Germany . |
| 9213576 | 12/1992 | Germany . |

*Primary Examiner*—Glenn Dawson
*Attorney, Agent, or Firm*—Ladas & Parry

[57] ABSTRACT

A pacifier (1) having a nipple portion (3) projecting from a shield portion (2), and a handle portion (4). A chewing portion suitable for chewing is formed by at least one chewing zone (8; 28; 38) having the form of a bead (9; 29; 39) and provided in a rim portion (6, 7) of the shield portion (2; 22; 32) itself.

17 Claims, 2 Drawing Sheets

PACIFIER HAVING A SHIELD WITH CHEWING BEADS

This application is a 371 of PCT/AT94/00043 filed on Apr. 13, 1994.

The invention relates to a pacifier comprising a nipple portion projecting from a shield portion and a handle portion as well as a chewing portion suitable for chewing.

Babies and infants tend to put objects into their mouths and to chew on them. This particularly holds for pacifiers, on which the child often sucks and chews not only the nipple portion provided therefor, but also other portions, such as the shield portion. Since the shield portion of pacifiers is generally made of relatively stiff, solid material, which in most instances is harder than the material of the nipple portion to guard against swallowing as well as for reasons of stability, this harbours the risk of injury to the child.

In GB-A-1 516 249 a pacifier is disclosed whose nipple portion is designed such as to keep the front teeth of the child using the pacifier free of the nipple portion. The nipple portion which is particularly designed for this purpose is provided with separate lateral arms for a front nipple body proper, and biting is enabled only on these lateral arms, with the side teeth. However, these arms are not suitable as specific chewing zones, but are to be considered only as holding arms, so that this known pacifier does not offer an improvement for the above-described situation—chewing on the shield portion, etc.—despite its complex design.

In babies or infants the urge to chew is particularly pronounced if they experience pain during teething, and biting on a chewing object, which preferably is not too hard, causes a temporary alleviation of the pain (caused by the initial cutting of the teeth).

From EP-B1-116 003 as well as from U.S. Pat. No. 3,267,937 and U.S. Pat. No. 3,669,117 it has already been known to equip pacifiers with handle rings designed as teething rings to serve as teething aids. However, this solution involves hygienic problems, since the ring provided as handle portion at the same time forms the teething ring, apart from the fact that the teething ring forms a separate element on the pacifier and is foreign thereto.

The invention aims at providing a pacifier of the initially defined kind which meets the needs and habits of babies and infants and which allows for a natural integration of a chewing zone into the pacifier in a simple and hygienically satisfying manner.

The pacifier according to the invention set out above is characterised in that at least one chewing zone forming a rim region of the shield itself is provided as the chewing portion.

With the pacifier according to the invention, thus at least a rim region of the shield portion itself forms a chewing zone, the material in this chewing zone or rim region of the shield portion being accordingly soft and fit for chewing. Hence results a natural incorporation of the chewing zone into an existing part of a pacifier, which then may be taken into the mouth as chewing portion without any problems. A further advantage involved is that sharp impressions often caused by a conventional shield rim about the mouth region of the baby due to vigorous sucking on the nipple portion and skin irritations connected therewith can be reduced at least substantially because the soft chewing-zone material contacts the area of the mouth region of the baby. In this connection it is furthermore particularly advantageous if a respective chewing zone is formed in each of two lateral rim regions of the shield portion which, in use, lie in the region of the corners of the mouth. This not only enables a symmetrical design of the pacifier in general, but equally ensures a gentle contact of the pacifier with its shield portion, on either side of the mouth, in the region of the corners of the mouth. This is particularly important for pacifiers having an elongate, in particular a lemniscate-shaped or oval shield portion, such as in AT-C-338 440 or AT-C 379 508.

It should be noted that from DE-C-33 47 876 as well as from DE-U-92 13576 it has already been known to inject nipple material around the entire shield structure so as to obtain a pacifier structure of as few individual parts as possible and which, in particular, cannot be disassembled. Apart from this very complicated injection moulding procedure, this also has the disadvantage of a relatively large consumption of expensive nipple material (silicone caoutchouk). Furthermore, the covering comprised of nipple material found in these known pacifiers is only thin, so that the shield portion, when chewed, nevertheless constitutes a hard abutment for the teeth or the jaws and thus is not suited as a chewing or teething portion.

It has also been suggested to provide the entire pacifier in one piece of silicone caoutchouk in a single injection moulding procedure, cf. U.S. Pat. No. 5,004,473. Such a pacifier altogether is too soft to make sure it cannot be swallowed and to ensure a sufficient stability, and thus such a pacifier may easily be swallowed. Furthermore, this pacifier requires particularly large amounts of expensive silicone caoutchouk material which is unacceptable for economic reasons.

Basically, in the pacifier according to the invention the shield portion could be made of a soft material, yet with a skeleton of a hard material, and then the chewing zone could be formed from a material as soft as the softer material of the shield portion. It is, however, preferred to design the entire shield portion uniformly of a relatively hard, stiff material, and in that case, the material of the chewing zone preferably is softer than the material of the remaining shield portion.

To provide for a good chewability it is suitable if the chewing zone is made of silicone caoutchouk, latex or a rubber-like material, preferably having a Shore-A-hardness of between 30 and 90.

The material of the chewing zone could as such be produced separately of the shield portion, and then it could be applied to the shield portion by means of a snap or catch connection, e.g. For reasons of safety, however, a solution in which the material of the chewing zone is undetachably applied to the shield portion is preferred.

One way of undetachably applying the material of the chewing zone to the shield portion in an advantageous manner is obtained if the material of the chewing zone is injection moulded onto the material of the shield portion. For a very intimate homogenous connection it is furthermore advantageous if the material of the chewing zone is intramolecularly cross-linked with the material of the shield portion.

On the other hand, the material of the chewing zone may also be glued or welded to the shield portion, wherein, e.g., an ultrasonic welding process may be used.

In addition or thereinstead the material of the chewing zone may also be anchored on the shield portion mechanically and/or by positive locking. In this connection it is particularly advantageous for a positive locking connection if material regions project through openings, such as emergency breathing openings or air drying openings, provided in the shield portion in a manner known per se, to anchor the material of the chewing zone on the shield portion. Furthermore, it is suitable if fixing holes are provided in the shield portion near the outer rim thereof and material webs project through these fixing holes to anchor the material of the chewing zone on the shield portion.

Basically, in regions of the shield portion where no chewing is expected to take place, such as, for instance, in the region of the neck of lemniscate-shaped pacifier shield portions, also a mechanical connection may be provided, which often is preferred for manufacturing reasons, and therefore an advantageous embodiment of the pacifier of the invention is characterised in that the material of the chewing zone is anchored on the shield portion by riveting or screwing.

It is furthermore advantageous if the chewing zone is made of a liquid-filled hollow body. This results in the additional chance of obtaining a particularly pain-alleviating effect, if the pacifier incorporating the liquid-filled hollow body of the chewing zone is cooled immediately before use.

For manufacturing reasons it has proved particularly suitable if the chewing zone is formed by a bead extending along at least part of the rim of the shield portion. In this case the bead is applied, in particular by injection moulding, to a shield portion made in a conventional manner. As a compromise between the requirement of a relatively thick, wide chewing zone, on the one hand, and a relatively slight thickening of the shield portion of the pacifier, on the other hand, it has proved suitable if the bead has a generally circular cross-section having a diameter of between 3 mm and 7 mm.

The invention will now be still further explained by way of particularly preferred, yet not limiting exemplary embodiments illustrated in the drawing.

Figure 1:
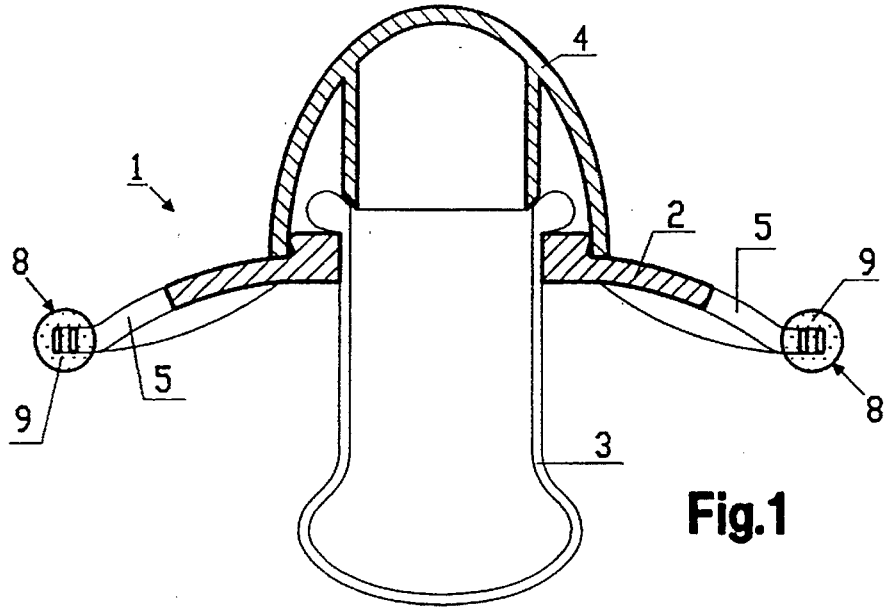
FIG. 1 shows a longitudinal section through a pacifier according to line I—I of FIG. 2.
Figure 2:
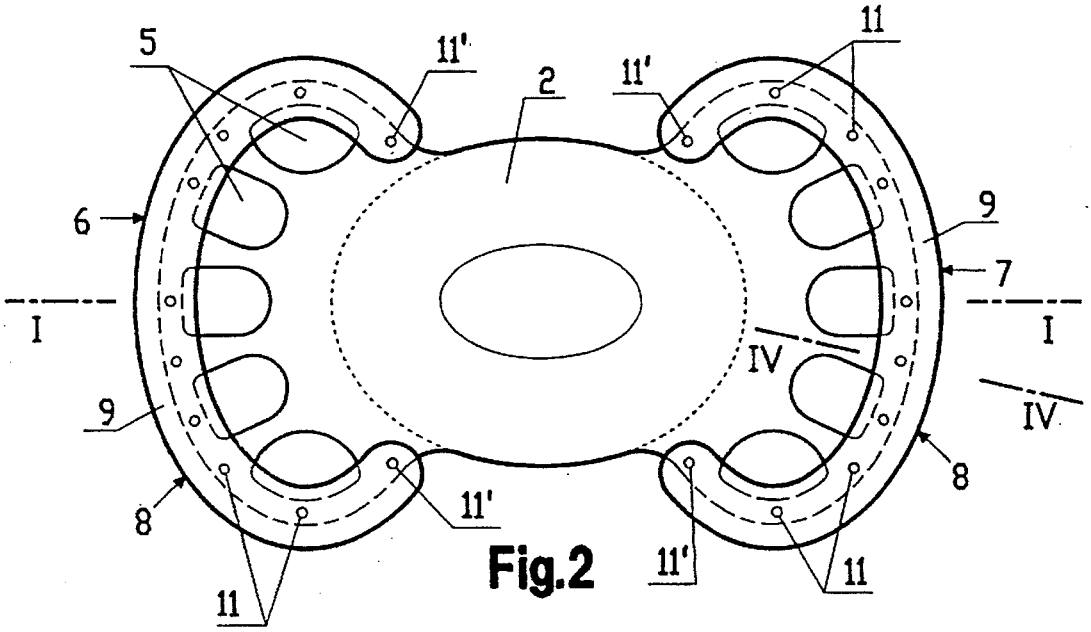
FIG. 2 shows a view of the shield portion of this pacifier seen from the nipple side, wherein, however, the nipple portion has been omitted for reasons of simplicity.

According to FIGS. 1 and 2 the pacifier 1 illustrated therein and at present considered as particularly preferred embodiment is comprised of a nipple portion 3 retained in a shield portion or mouth shield 2; on the side of the shield portion 2 facing away from the nipple portion 3, a cap-shaped handle portion 4 is locked on the shield portion 2 and/or glued thereto. Insofar the general construction of the pacifier 1 corresponds to the construction illustrated in AT-C-379 508 or AT-C-338 440.

The nipple portion 3 ("nipple" in short hereafter) is comprised of natural caoutchouk, silicone caoutchouk or an other rubber-like material which meets the requirements with regard to softness, strength and compatibility. The shield portion 2 ("shield" in short hereafter) and the cap-shaped handle portion 4 ("cap" in short hereafter) are comprised of a material, e.g. polypropylene of polycarbonate, which is stiff and solid as compared to the nipple material, so as to reliably prevent a baby or infant from deforming the whole pacifier 1 and taking it into his or her mouth in an incorrect and jeopardizing orientation.

In the shield 2 relatively large openings 5 are furthermore provided, which serve as emergency breathing or air drying openings, cf. also the above-mentioned AT-C-379 508.

In both of its lateral rim regions opposing each other, which, in use, contact the region of the corners of the mouth or the cheeks of the child and which are generally illustrated at 6 and 7 in FIG. 2, the shield 2, which is approximately lemniscate-shaped in top view (cf. FIG. 2), is provided with chewing zones 8 in the form of beads 9. The beads 9 are entirely comprised of a rubber-like material which, due to its softness and dimensions, enables the infant or baby to chew and bite thereon and, in particular, to alleviate the teething pain while shortly inhibiting the growing of the teeth.

Silicone caoutchouk or a similar rubber material having a Shore A-hardness of between 30 and 90 is particularly used as the material for the beads 9, this bead material being applied around the rim of the shield 2 by an injection moulding procedure. The approximate bead thickness, i.e. the diameter of the beads 9 of approximately circular cross-sections (cf. also FIGS. 3 and 4) is chosen in dependence on the softness of the material so as to be between 3 mm and 7 mm.

Figure 3:
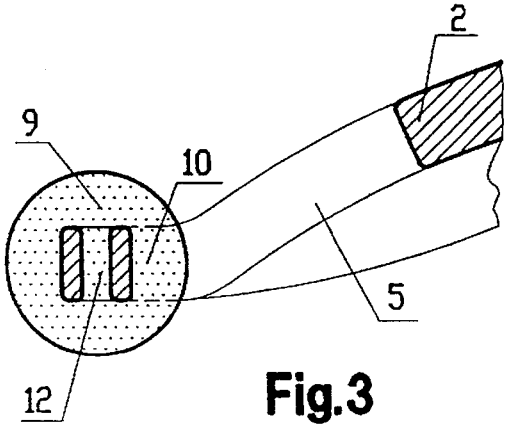
FIG. 3 shows a partial section through the rim region of the shield portion with the bead surrounding it, on an enlarged scale and substantially according to line I—I of FIG. 2.
Figure 4:
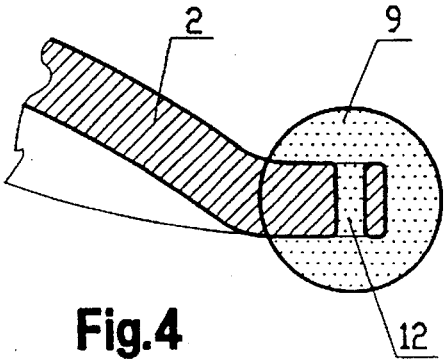
FIG. 4 shows a corresponding section through the shield rim including the bead according to line IV—IV of FIG. 2 on an enlarged scale.

Material of the beads 9 extends through the openings 5 in the shield 2, as is illustrated at 10 in FIG. 3, whereby the beads are anchored on the shield 2. To additionally anchor the beads 9 on the rim of the shield, small fixing holes 11 are provided in the respective rim regions 6 and 7 of the shield in an arrangement corresponding to a line equidistant to the shield rim, the bead material also flowing through these fixing holes during the injection moulding procedure, thus forming material webs 12, cf. FIGS. 3 and 4. When making the shield 2 (by injection moulding), these holes 11 are simultaneously formed like the openings 5. From FIGS. 3 and 4 there results that the beads 9 in those regions where their material can flow through the openings 5 on the side of the rim when injection moulded therearound have a closed ring circumference (FIG. 3) and that in those regions, where there are no openings 5, at least a material web 12 in a fixing hole 11 anchors the bead 9 on the shield 2 (FIG. 4). Where they face the shield rim, the openings 5 may, as can be seen from FIG. 2, extend parallel to this shield rim, whereby the material region 10 within the respective opening 5 has a constant thickness. In contrast thereto, however, more rounded openings 5 could, e.g., be provided resulting in through-going material regions 10 of the beads 9 of varying thicknesses. However, in order to obtain a particularly good anchoring, the embodiment illustrated which has the rims of the openings parallel to the rim of the shield is preferred.

In addition to, or instead of, the above-described mechanical anchoring of the beads 9 by aid of the material regions 10 extending through the openings 5 and the material webs 12 extending through the additional holes 11, a shield-bead unit may also be obtained ba a single injection moulding method, by a two-component injection moulding procedure, in-which the temperature is controlled such that a partial fusion or cross-linking of the two materials occurs at the zones of contact between the material of the shield 2 proper and that of the beads 9; in this manner, extremely good anchoring is obtained.

Beyond this, it would also be feasible to produce the beads 9 separately from the shield 2 and to fasten the beads on the rim regions 6, 7 of the shield 2, by gluing or welding, in particular by ultrasonic welding. In this case, also the fixing holes 11 may be omitted.

Figure 5:
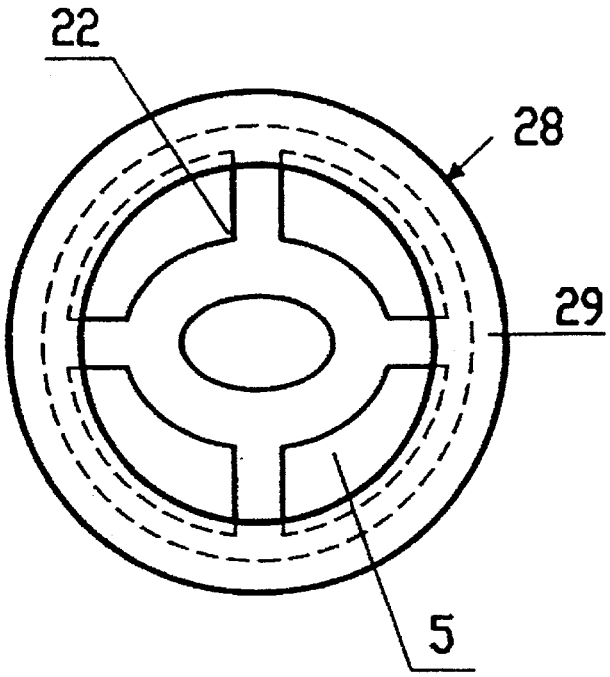
FIGS. 5 and 6 show two further exemplary embodiments comprising rim-side chewing zones on the shield portion in views similar to that of FIG. 2.
Figure 6:
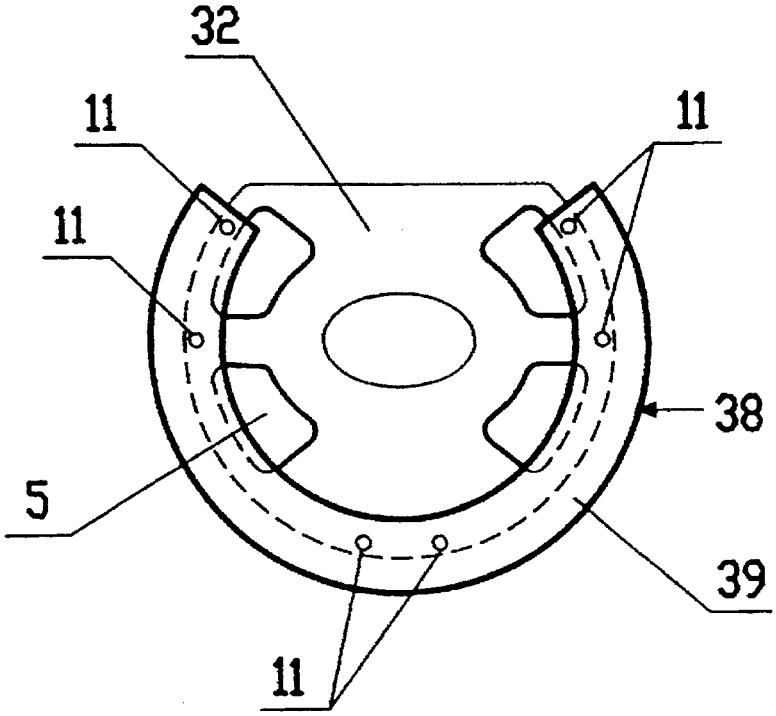

FIGS. 5 and 6 show embodiments which have been altered as compared to FIG. 2, wherein a single bead 29 or 39, respectively, is applied on the rim of the respective shield 22 or 32 as the chewing zone 28 or 38, respectively. In the case of FIG. 5, a shield portion 22 of circular shape, seen from the front side thereof, is provided, the entire rim or circumference thereof being encircled by a chewing bead 29, whereas in the case of FIG. 6 a substantially circular shield 32 having, however, a flattened upper side, is provided, in which the rim region has a chewing zone bead 39 in correspondence with the circular arc resulting without the flattened portion, i.e. with the exception of the flattened portion provided for the nose of the respective infant.

In the embodiments according to FIGS. 5 and 6, the beads 29 or 39, respectively, may also be anchored on the shield 22 or 32, respectively, by positive locking via larger emergency breathing or air drying openings 5, arranged e.g. like a grid, as well as, if desired, also via smaller fixing holes 11 (FIG. 6).

In addition to the above-described ways of anchoring, the respective bead 9 or 29 or 39, may be anchored on the shield 2 or 22 or 32, respectively, also by mechanical means, such as by riveting, screwing, or locking, in particular by means of snapping or locking elements preventing later detachment. Of course, the connecting elements are to be arranged and selected such that they do not interfere with chewing and biting. With the pacifier 1 according to FIGS. 1 and 2, this applies, e.g., to the inwardly arranged ends of the beads 9 in the region of the holes 11'—at these locations there is hardly a chance that the baby will chew on the respective bead 9, i.e. due to the indentations of the lemniscate-shaped shield 2.

According to FIGS. 3 and 4, the material for the chewing zones 8, i.e. for the beads 9, is solid, whereas in principle it would also be possible to form these chewing zones 8 by bead-like hollow bodies that may be filled with a liquid, as is known per se from U.S. Pat. No. 3,669,117 for a one-piece pacifier which is entirely filled with a liquid. In this case it is possible to refrigerate the pacifier 1 and thus the liquid filling immediately before use, a cooled liquid filling additionally having a pain-alleviating effect.

A further modification in view of the embodiments described before would also reside in the provision of a full-surface shield portion 2 or 22 or 32, respectively, which thus would not have any openings 5 or holes 11, and to provide the, e.g. bead shaped, laterally slitted chewing zone(s) 8 or 28 or 38, respectively, on this shield portion 2 by injection moulding around, gluing on, welding on etc.

Furthermore, it is not absolutely necessary that the respective chewing bead 9 or 29 or 39, respectively, be of generally circular cross-section, an oval cross-sectional shape, e.g., being equally conceivable.

I claim:

1. A pacifier comprising a lemniscate-shaped shield portion made of a rigid material, a nipple portion projecting from the shield portion and a handle portion connected to the shield portion on a side thereof opposite to the nipple portion, said shield portion having two lateral rim regions, which, in use, lie in the region of the corners of the mouth of the user, respectively; chewing beads being applied to the lateral rim regions of the shield portion to enclose said rim regions, said chewing beads being made of a material softer than the shield portion material, and being suitable for chewing thereon.

2. A pacifier according to claim 1, wherein the material of the chewing beads is a rubber-like material.

3. A pacifier according to claim 1, wherein the material of the chewing beads is latex.

4. A pacifier according to claim 1, wherein the material of the chewing beads is silicone caoutchouk.

5. A pacifier according to any one of claims 2 to 4, wherein the material of the chewing beads has a Shore A-hardness of between 30 and 90.

6. A pacifier according to claim 1, wherein the material of the chewing beads is undetachably applied to the shield portion.

7. A pacifier according to claim 1, wherein the material of the chewing beads is injection molded onto the material of the shield portion.

8. A pacifier according to claim 1, wherein the material of the chewing beads is intermolecularly cross-linked with the material of the shield portion.

9. A pacifier according to claim 1, wherein the chewing beads are glued to the shield portion.

10. A pacifier according to claim 1, wherein the chewing beads are welded to the shield portion.

11. A pacifier according to claim 1, wherein the chewing beads are anchored on the shield portion.

12. A pacifier according to claim 11, wherein material regions of the chewing beads project through openings, provided in the shield portion, to anchor the chewing bead on the shield portion.

13. A pacifier according to claim 11, wherein fastening holes are provided in the shield portion near the lateral rim regions, and web portions of the material of the chewing beads project through these fastening holes to anchor the material of the beads on the shield portion.

14. A pacifier according to claim 11, wherein the chewing beads are anchored on the shield portion by riveting.

15. A pacifier according to claim 11, wherein the chewing beads are anchored on the shield portion by screwing.

16. A pacifier according to claim 1, wherein the chewing beads are made of a liquid-filled hollow body.

17. A pacifier according to claim 1, wherein the chewing beads have a generally circular cross-section having a diameter of between 3 mm and 7 mm.

* * * * *